United States Patent [19]

Hintsch

[11] Patent Number: 4,674,544

[45] Date of Patent: Jun. 23, 1987

[54] WEAVING MACHINE PROJECTILE BRAKE

[75] Inventor: Otto Hintsch, Wallisellan, Switzerland

[73] Assignee: Sulzer Brothers, Winterthur, Switzerland

[21] Appl. No.: 810,038

[22] Filed: Dec. 17, 1985

[30] Foreign Application Priority Data

Jan. 28, 1985 [EP] European Pat. Off. ..... 85 100855.7

[51] Int. Cl.[4] ..... D03D 45/54

[52] U.S. Cl. ..... 139/185

[58] Field of Search ..... 139/185, 186, 187

[56] References Cited

U.S. PATENT DOCUMENTS

| | | | |
|---|---|---|---|
| 2,956,591 | 10/1960 | Sherwood | 139/185 |
| 3,865,150 | 2/1975 | Demuth | 139/185 |
| 4,169,492 | 10/1979 | Grady | 139/185 |

*Primary Examiner*—Henry S. Jaudon

*Attorney, Agent, or Firm*—Kenyon & Kenyon

[57] ABSTRACT

The movable brake shoe of the projectile brake is controlled by a wedge shaped adjusting member. A servomotor and spindle arrangement are used to move the adjusting member so as to adjust the position of a slider which, in turn, serves to adjust the amount of movement of the movable brake shoe towards the stationary brake shoe during a braking operation.

4 Claims, 2 Drawing Figures

WEAVING MACHINE PROJECTILE BRAKE

This invention relates to a weaving machine projectile brake.

As is known, various types of brakes have been used for braking a projectile in a weaving machine to a stop on the catching side of a shed in the weaving machine. In many cases, the brakes have been constructed of a pair of brake shoes which are brought together in order to brake the projectile to a stop. Further, it has been known that the brake shoes can be adjusted relative to each other in order to adjust the braking force supplied to a projectile. For example, it has been known to adjust a top brake shoe relative to a bottom brake shoe by means of a stepping motor which drives, via an endless chain, a screw-threaded spindle secured in the top brake shoe. However, such an adjusting arrangement is associated with high specific surface pressures which require expensive manufacturing processes.

Accordingly, it is an object of the invention to provide a projectile brake which can be adjusted using relatively inexpensive components.

It is another object of the invention to provide a relatively simple adjusting arrangement for a projectile brake.

Briefly, the invention provides a projectile brake which is comprised of a stationary brake shoe, a movable brake shoe, a servomotor for controlling movement of the movable brake shoe towards the stationary brake shoe, a spindle which is driven by the servomotor and a wedge-shaped adjusting member between the spindle and the movable brake shoe for adjusting the position of the movable brake shoe in response to rotation of the spindle.

Figure 1:
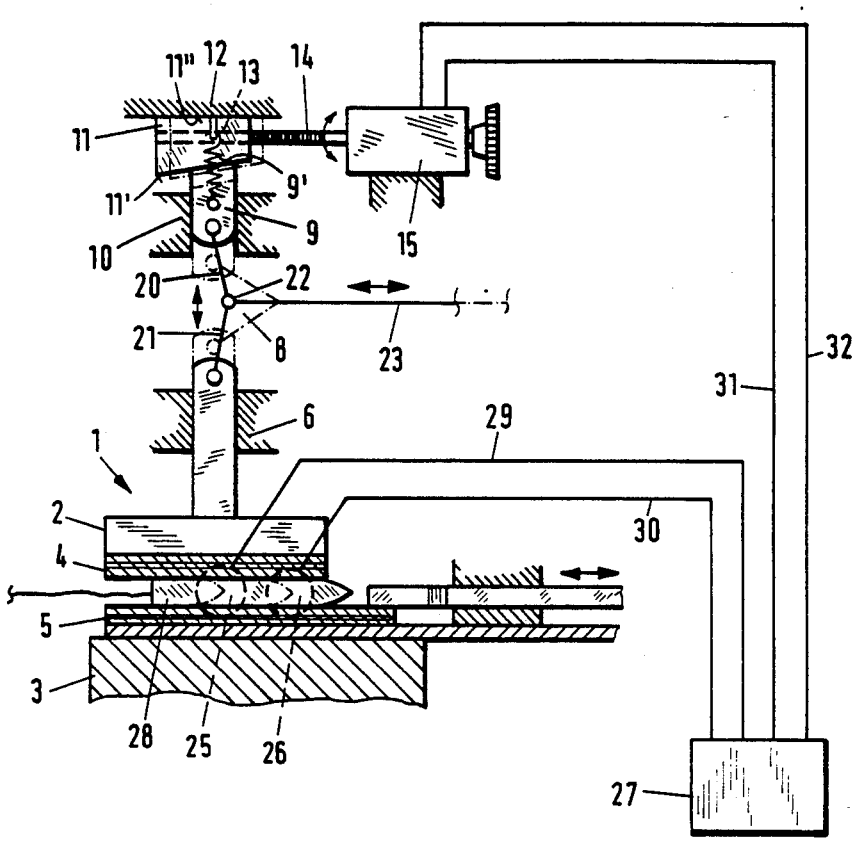
Figure 2:
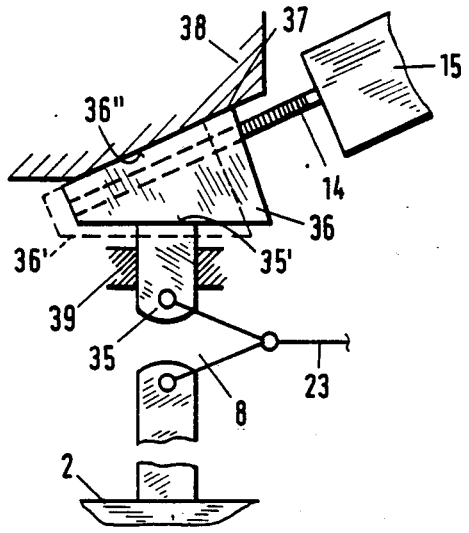

These and other objects and advantages of the invention will become more apparent from the following detailed description taken in conjunction with the accompanying drawings wherein:

FIG. 1 illustrates a schematic view of a projectile brake constructed in accordance with the invention; and FIG. 2 illustrates a modified projectile brake according to the invention.

Referring to FIG. 1, the projectile brake 1 is provided with a bottom stationary brake shoe 3 and a top movable brake shoe 2 which is disposed in spaced facing relation to the stationary brake shoe 3 in order to brake a projectile 28 therebetween. As indicated, both of the brake shoes 2, 3 are provided with respective brake linings 4, 5 which are disposed in facing relation.

The movable brake shoe 2 includes a stem which is reciprocably mounted with a guide 6 and is connected by a linkage 8 to a slider 9 which is also reciprocably mounted for vertical movement in a guide 10. Further, the upper end surface 9' of the slider engages a parallel inclined surface 11' of a wedge-shaped adjusting member 11. This adjusting member 11 is, in turn, slidably mounted on an opposite surface 11'' on a surface of the weaving machine 12. A spring 9' is also provided for biasing the slider 9 in an upward direction, as viewed, against the adjusting member 11. As illustrated, the spring 9' is fixed at one end to the weaving machine 12 while being fixed at the opposite lower end to a pin on the slider 9.

The linkage 8 between the movable brake shoe 2 and the slider 9 includes a pair of levers 20, 21 which are connected to one another by an articulation 22 as well as to a machine-actuated brake lever 23. This lever 23 is reciprocable as indicated by the double arrow so as to apply and release the brake 1 on a projectile, that is, to raise and lower the movable shoe 2 within the guide 6 relative to the stationary brake shoe 3 e.g. as described in U.S. Pat. Nos. 2,538,798 and 3,865,150.

A means for moving the adjusting member 11 to effect movement of the slider 9 is also provided so that movement of the movable brake shoe 2 towards the stationary brake shoe 3 can be adjusted in order to vary the braking effect therebetween. As indicated, this means includes a screwthread adjusting spindle 14 which is received in a tapped bore 13 of the adjusting member 11 and a servomotor 15 for rotatiing the spindle 14 in order to move the adjusting element 11 relative to the slider 9.

The brake 1 is also provided with a pair of sensors 25, 26 and a control device 27. The sensors 25, 26 are disposed along the braking path of the projectile 28 and are connected by way of respective lines 29, 30 to the control device 27. Each sensor 25, 26 serves to detect the presence of the braked projectile thereat and emit a signal in response thereto via the respective line 29, 30 to the control device 27. In turn, the control device 27 has an output connected by way of lines 31, 32 to the servomotor 15 in order to actuate the servomotor 15 in response to a received signal from a sensor 25, 26 in order to move the adjusting member 11 in a given predetermined direction.

Depending upon the braking, that is, upon the depth of penetration of the projectile 28 between the brake shoes 2, 3 the control device 27 forms an appropriate signal for the servomotor 15 to adjust the adjusting member 11. For example, if the projectile 28 does not enter far enough into the brake 1, that is, if braking is excessive, the sensor 25 emits a signal via the line 29 to the control device 27 and the control device 27 emits a signal via the line 31 to the servomotor 15 to press the wedge 11 to the left, as viewed, so that the spring pressure lifts the slider 9. Thus, when the brake lever 23 is actuated, the motion delivered to the slider 9 and movable brake shoe 2 is such that there is a reduced movement of the brake shoe 2 towards the stationary brake shoe 3 and thus a reduced braking effect.

If the projectile 28 enters too far into the brake, that is, if braking is inadequate, the sensor 28 delivers a signal via the line 30 to the control device 27 which, in turn, delivers a signal via the line 32 to the servomotor 15 to pull the adjusting element to the right, as viewed. This in turn lowers the slider 9 so that when the brake lever 23 is subsequently actuated, the movable brake shoe 2 is moved further towards the stationary brake shoe 3 to increase the braking effect.

If braking is correct, the control device 27 does not form any adjusting signal for the servomotor 15.

Referring to FIG. 2, wherein like references indicate like parts as above, the slider 35 which is articulated to the movable brake shoe 2 is guided in a guide 39 and has a flat surface 35' which is in slidable contact with a parallel rectilinear side 36' of the adjusting member 36. In this case, the adjusting member 36 has an inclined side 36'' which is in slidable engagement with an inclined surface 37 of the weaving machine 38.

The operation of the adjusting member 36 is similar to that as described above. The advantage of this arrangement is that the slider 35 experiences only axial adjusting forces. Consequently, there is little friction between the slider 35 and the guide 39 and vibrations or oscillations of the movable brake shoe 2 are obviated.

Of note, the wedge shaped adjusting elements may be manufactured from plain bearing material so that the required adjusting force is reduced.

The invention thus provides a projectile brake which cana be readily adjusted to accommodate different braking effects.

Further, the invention provides an adjusting arrangement for the projectile brake which utilizes relatively inexpensive components.

What is claimed is:

1. A projectile brake for a weaving machine comprising a stationary brake shoe;

a movable brake shoe disposed in spaced facing relation to said stationary brake shoe to brake a projectile therebetween;

a reciprocally mounted slider;

a linkage connecting said slider with said movable brake shoe;

a brake lever for actuating said linkage to move said movable brake shoe relative to said slider and to said stationary brake shoe;

a wedge-shaped adjusting member disposed in slidable relation with said slider;

means for moving said adjusting member to effect movement of said slider whereby movement of said movable brake shoe towards said stationary brake shoe is adjustable to vary a braking effect therebetween said means including a threaded spindle rotatably secured in said adjusting member and a servomotor for rotating said spindle to move said adjusting element relative to said slider;

at least one sensor adjacent said brake shoes to detect the presence of a braked projectile thereat and to emit a signal in response thereto; and a control device connected to and between said sensor and said servomotor to actuate said servomotor in response to a signal from said sensor to move said adjusting member in a predetermined direction.

2. A projectile brake as set forth in claim 1 wherein said adjusting member has an inclined side contacting an inclined side of said slider and is movable transversely of said slider.

3. A projectile brake as set forth in claim 1 wherein said adjusting member has a rectilinear side contacting a parallel side of said slider and being movable angularly of said slider.

4. A projectile brake for a weaving machine comprising a first brake shoe;

a movable brake shoe disposed in spaced facing relation to said first brake shoe to brake a projectile therebetween;

a reciprocally mounted slider;

a linkage connecting said slider with said movable brake shoe;

a brake lever for actuating said linkage to move said movable brake shoe relative to said slider and to said first brake shoe;

a wedge-shaped adjusting member disposed in slidable relation with said slider;

means for moving said adjusting member to effect movement of said slider whereby movement of said movable brake shoe relative to said first brake shoe is adjustable to vary a breaking effect therebetween;

at least one sensor adjacent said brake shoes to detect the presence of a braked projectile thereat and to emit a signal in response thereto; and a control device connected to and between said sensor and said means to actuate said means in response to a signal from said sensor to move said adjusting member in a predetermined direction.

* * * * *

UNITED STATES PATENT AND TRADEMARK OFFICE

CERTIFICATE OF CORRECTION

PATENT NO. : 4,674,544

DATED : June 23, 1987

INVENTOR(S) : OTTO HINTSCH

It is certified that error appears in the above-identified patent and that said Letters Patent is hereby corrected as shown below:

Column 2, line 12 "screwthread" should be -screwthreaded-
Column 2, line 14 "rotatiing" should be -rotating-
Column 2, line 22 "and emit" should be -and to emit-
Column 3, line 7 "cana" should be -can-

Signed and Sealed this

Nineteenth Day of January, 1988

*Attest:*

*Attesting Officer*

DONALD J. QUIGG

*Commissioner of Patents and Trademarks*